US008469620B1

(12) United States Patent
Gilbert

(10) Patent No.: US 8,469,620 B1
(45) Date of Patent: Jun. 25, 2013

(54) DISPENSER AND APPLICATOR DEVICE

(75) Inventor: Renee J. Gilbert, Harwinton, CT (US)

(73) Assignee: Renee J. Gilbert, Harwinton, CT (US)

( * ) Notice: Subject to any disclaimer, the term of this patent is extended or adjusted under 35 U.S.C. 154(b) by 1020 days.

(21) Appl. No.: 12/014,963

(22) Filed: Jan. 16, 2008

(51) Int. Cl.
*A46B 11/00* (2006.01)

(52) U.S. Cl.
USPC ..... 401/12; 401/11

(58) Field of Classification Search
USPC ..... 401/9, 11, 12, 183, 184, 185
See application file for complete search history.

(56) References Cited

U.S. PATENT DOCUMENTS

| | | | | |
|---|---|---|---|---|
| 1,097,405 | A | 5/1914 | Pratt | |
| 2,458,120 | A * | 1/1949 | Volpini | 401/12 |
| 2,930,061 | A * | 3/1950 | O'Neil | 401/11 |
| 2,527,149 | A | 10/1950 | Peterson | |
| 2,565,874 | A | 8/1951 | Mossal | |
| 2,690,657 | A | 10/1954 | Milewski | |
| 2,756,495 | A | 7/1956 | Wasser | |
| D178,487 | S | 8/1956 | Becker | |
| 2,811,844 | A | 11/1957 | Selmer | |
| 2,814,888 | A | 12/1957 | Wellinger | |
| 2,893,032 | A | 7/1959 | Selmer | |
| 3,088,470 | A * | 5/1963 | Hall | 401/11 |
| 3,669,063 | A | 6/1972 | Daniluke | |
| 3,735,487 | A | 5/1973 | Wojcik | |
| 4,408,919 | A | 10/1983 | Wolff et al. | |
| D272,796 | S | 2/1984 | Wolff | |
| 5,122,056 | A * | 6/1992 | Barbee | 433/80 |
| 5,890,630 | A | 4/1999 | Lobdell | |
| 6,290,412 | B1 | 9/2001 | Birmingham | |
| D478,483 | S | 8/2003 | Kotsonis | |
| 7,150,574 | B1 | 12/2006 | Cerqua | |
| 7,226,230 | B2 * | 6/2007 | Liberatore | 401/266 |

* cited by examiner

*Primary Examiner* — David Walczak

(57) ABSTRACT

A spreadable material dispenser and applicator device, comprising: a longitudinally extending handle comprising an interior cavity, wherein the interior cavity holds a spreadable material; and a body comprising an interior cavity enveloped by a top surface and a bottom surface, wherein the bottom surface comprises a plurality of perforations, and wherein the handle is disposed on the top surface, and further wherein the body terminates in a first flange and a second flange. The device may further comprise a container for storing the spreadable material, wherein the container may be fixedly connected to the handle to assist in the dispersion of the spreadable material.

1 Claim, 4 Drawing Sheets

DISPENSER AND APPLICATOR DEVICE

BACKGROUND OF THE INVENTION

1. Field of the Invention

The present invention relates generally to dispensers and applicators, and more particularly to a device for dispensing and applying a spreadable material onto a complementary item, such as butter onto an ear of corn.

2. Background

Food spreads, such as butter and margarine, are often used on hot food, such as cooked ears of corn. Conventionally, butter is spread on the ear of corn with a butter knife or similar utensil. Since the knife offers only a planar surface, the butter remains positioned on the knife through adhesion only, with no further engagement. Thus, the butter easily slides off the knife when melted and can drip onto a table or the user's clothing, thereby causing damage through staining. Further, because the butter is not held stably in place on the knife, the butter distribution on the ear of corn is uneven in terms of volume and surface area coverage, resulting in much of the melted butter being wasted. Thus, a device for applying a food spread solving the aforementioned problems is desired.

SUMMARY OF THE INVENTION

A dispenser and applicator device, comprising: a longitudinally extending handle comprising an interior cavity, wherein the interior cavity holds a spreadable material; a body comprising an interior cavity enveloped by a convex-shaped top surface and a concave-shaped bottom surface, wherein the bottom surface comprises a plurality of perforations, and wherein the handle is disposed on the top surface, and further wherein the body terminates in a first flange and a second flange. The device may further comprise a compressible container attached to the handle, wherein the container stores and holds the spreadable material for extended periods of time.

DETAILED DESCRIPTION OF THE INVENTION

Figure 1:
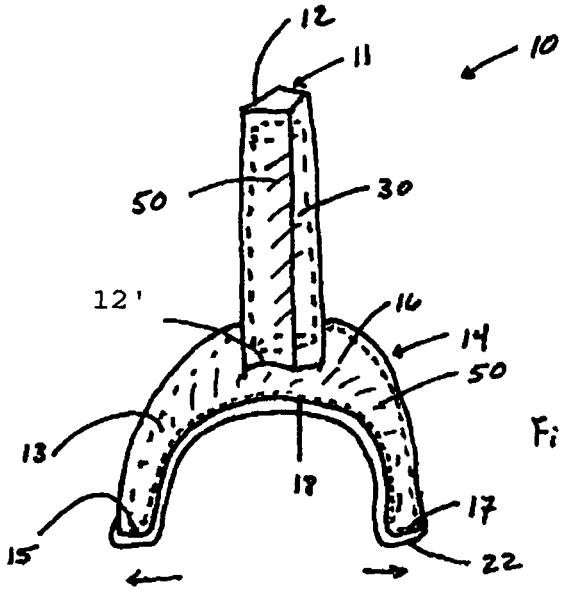
FIG. 1 is a schematic depicting an exemplary food spread applicator and dispenser device of the present invention.

The food spread dispenser and applicator device of the present invention (the "device") is configured to dispense and to evenly apply a food spread on a substantially cylindrical food item. The device comprises one or more materials which allows the device to hold and to store the food spread for the typically-found shelf-life of the particular food spread, wherein shelf-life is defined as the time in which the food spread remains fresh and healthy to consume when handled under the food spread's recommended handling instructions. Furthermore, in an exemplary embodiment, the device may be refrigerated to preserve the freshness of the food spread, and/or is microwave-safe so that the consistency of the food spread may be modified to facilitate its dispersion and application without causing damage to the integrity of the device or without affecting the edibleness of the food spread. Also, in an exemplary embodiment, the device comprises a material (s) that imparts sufficient pliability and elasticity onto the device so that a single device may be used to dispense and apply the food spread to substantially cylindrical food items having a variety of diameters, wherein such pliability and elasticity allows the device to flex and rebound to its original shape even after a repeated number of uses. Additionally, because the food spread is dispensed by applying a compressive force onto the device, the device comprises a material that is readily compressible when exposed to a threshold amount of compressive force. Exemplary materials for forming the device, therefore, include, for example, at least one of a wide variety of plastics, rubbers, and the like.

In general, the device of the present invention comprises a handle disposed on an arcuate body, wherein the food spread is contained within an interior cavity of the handle, and dispersible into a hollow interior cavity of the arcuate body. The arcuate body comprises a perforated bottom surface, and terminates at its two end points into respective flanges. As the device is positioned onto the substantially cylindrical food item, the device is pressed against the food item such that an outwardly expanding force is directed against the two flanges such that the flanges move away from each other, thereby expanding the space between the flanges which allows for a wide variety of sized food items to be positioned between the flanges and gripped thereby. Once the food item is properly positioned between the two flanges, the flanges, along with all or a substantial portion of the remainder of the bottom surface of the arcuate body is in direct physical contact with the food item such that the food item is lightly gripped by the arcuate body, i.e., the arcuate body is in direct physical contact with the food item, but is able to slide along an outer surface of the food item when subjected to a threshold level of force.

In an exemplary embodiment, the food spread is disposed on the food item by applying a compressive force onto the handle once the device is positioned on the food item. The compressive force moves the food spread out of the handle and into the cavity of the arcuate body. The continued exertion of a compressive force on the handle causes the food spread to move out of the arcuate body via the perforations and onto the food item. By moving the device along the length and/or along the transverse surface of the food item while applying the compressive force, the food spread may be evenly applied to the food item.

In an alternative embodiment, the device further comprises a compressible container which is either permanently or removably attached to the handle. In this embodiment, the container preferably holds at least a majority of the food spread. When in use, the container is squeezed such that the food spread is dispensed from the container and into the cavities of the handle and the arcuate body. This same compressive force also disperses the food spread from the perforations located on the arcuate body thereby emitting the food spread from the device. The container in this alternative embodiment serves to store and hold the food spread; accordingly, the container may comprise any receptacle or holding device conventionally known to hold and store food spreads. In this embodiment, the handle and the arcuate body may be removable from the container, such that the container may be used to dispense the food spread in conventionally known ways. In this way, then, the versatility of conventionally known containers is enhanced.

Although the food spread may comprise any consumable product that can be squeezed out of the dispenser described herein, and that can spread onto the substantially cylindrical food item, and which may include, for example, butter, butter substitutes, mustard, ketchup, mayonnaise, and the like, a particularly exemplary food spread comprises butter and butter substitutes. Additionally, the food spread may comprise a variety of forms, and have a number of consistencies, for example, where the food spread comprises butter or a butter substitute (collectively referred to herein as "butter" unless specifically stated otherwise), the food spread may be salted, non-salted, or whipped, wherein the only important consideration is that, when exposed to the threshold level of compressible force, the food spread moves out of the device via the perforated bottom surface of the arcuate body, and onto the food item.

The food item comprises any piece of food onto which a complementary food spread may be dispensed and uniformly applied utilizing the device of the present invention. In an exemplary embodiment, the substantially cylindrical food item comprises an ear of corn, where the complementary food spread comprises butter. It is noted, that although an exemplary body of an exemplary device is described as "arcuate", and an exemplary food item is described as "substantially cylindrical", the body and/or the food item may comprise a wide variety of geometrical shapes and configurations without deviating from the principles of the present invention. Accordingly, what is important is that the body of the device be able to evenly dispense and distribute a food spread onto the food item according to the principles of the invention as disclosed herein.

It is also noted herein that the invention is not limited to the application of an edible spread onto an edible item. Rather, it is contemplated that any spreadable material may be applied to a complementary item pursuant to the principles of the present invention. Accordingly, in addition to edible materials, the spreadable material may further comprise non-edible materials including, for example, glue, paint, clay, and the like.

The device of the present invention shall be more specifically described with reference to the figures. Referring to FIG. 1, an exemplary device 10 comprises a handle 11 which longitudinally extends from a convex top surface 16 of an arcuate body 14. Handle 11 comprises a cavity 30 within its interior. Unlike in the embodiment depicted in FIG. 12', in which the handle comprises two open terminal ends 12 and 15, i.e., two terminal ends which both allow movement of the spreadable material in and out of the handle, in the embodiment depicted in FIG. 1, handle 11 may comprise an end 12 which is either permanently or temporarily closed or open. That is, when device 10 is refillable, end 12 is preferably either open or capable of being opened, i.e., fitted with a cap or other cover, so that a supply of the spreadable material may be replenished.

Body 14 comprises a concave bottom surface 18 which comprises a plurality of perforations 20 evenly dispersed thereon. Arcuate body 14 terminates at a first flange 15 and a second flange 17. Body 14 further comprises a cavity 13 formed through a substantial portion of an interior of arcuate body 14.

Referring to FIG. 1, device 10 may further comprise a removable cap 22 fitted over plurality of perforations 20, wherein in an exemplary embodiment, cap 22 is fitted onto arcuate body 14 such that a top outer edge of cap 22 creates a seal with an outer edge of bottom surface 18 when device 10 is not in use, thereby preserving the freshness of the food spread and keeping the food spread contained within the device when not in use.

Referring to FIG. 3, an alternative embodiment of the present invention includes a device 58 comprising handle 11 and arcuate body 14 as discussed above with reference to FIGS. 1-3, in addition to a container 60. Container 60 comprises a housing 63 having a hollow interior 64. Container 60 further comprises a lid 66 secured onto a top portion of housing 63. Lid 66 comprises a hole (not shown) through which a protrusion 68 extends. Protrusion 68 comprises a channel (not shown) in its interior which is continuous with the hole of lid 66, wherein the hole and the channel are exposed to hollow interior 64 of housing 63. Protrusion 68 is fitted securely within a portion of cavity 30 of handle 11. As will be discussed further below, in application, the food spread is contained and stored within interior 64 of housing 63. Upon exertion of a certain degree of compressive force, the food spread moves out of container 60 via the channel formed in protrusion 68. The food spread continues its egress out of device 58 by moving through cavity 30 of handle 11 and through cavity 13 of arcuate body 14 out through perforations 20.

As container 60 comprises a receptacle conventionally used to store various types of food spreads, the embodiment depicted in FIG. 5 provides a mechanism whereby the food spread can be stored in conventionally used containers, and whereby handle 11 and arcuate body 14 can be fitted onto container 60 thereby enhancing the effectiveness of container 60 in the application of the food spread to a food item.

Figure 2:
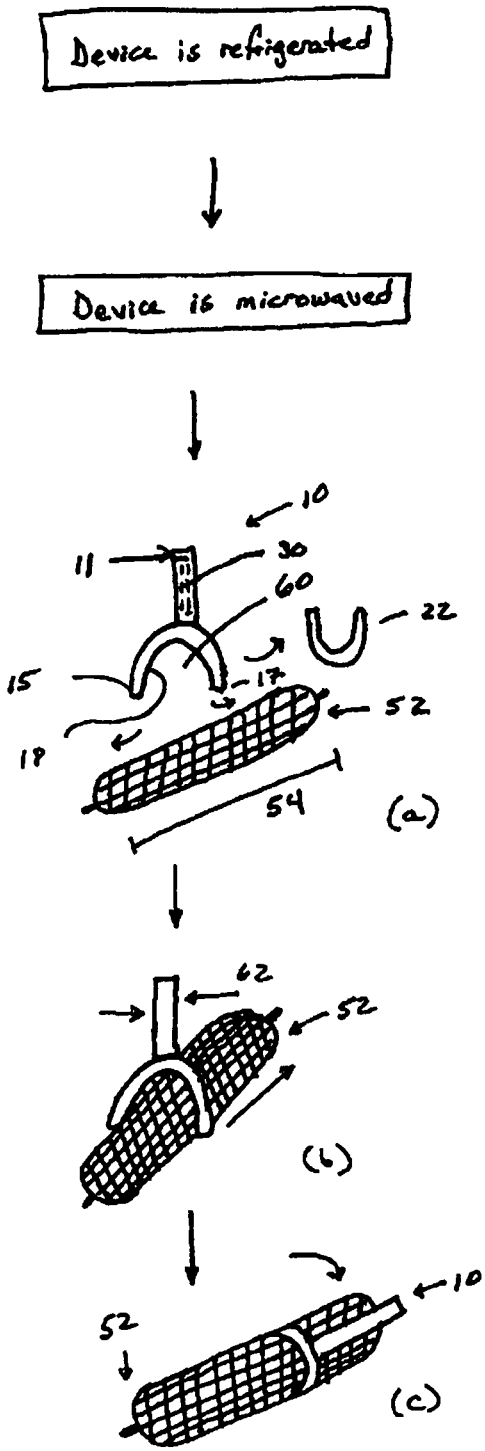
FIG. 2 is a schematic depicting an exemplary method of use of the device depicted in FIG. 1.
Figure 3:
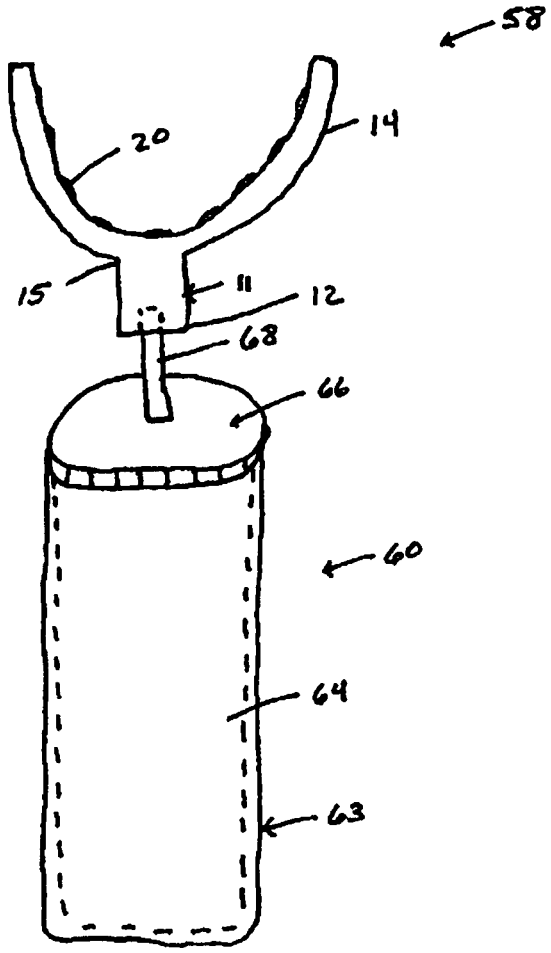
FIG. 3 is a schematic depicting another exemplary food spread applicator and dispenser device of the present invention.
Figure 4:
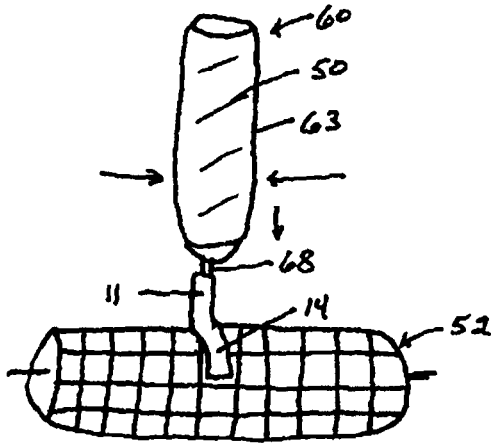
FIG. 4 is a schematic depicting an exemplary method of use of the device depicted in FIG. 5.

An exemplary application of device 10 and device 58 is in the application of butter to an ear of corn, such as is depicted in FIGS. 2 and 4 respectively. However, it is to be noted that other food spreads may be used on the same or other food items, wherein the general method of dispensing and applying the food source to the food item is identical or substantially the same.

Referring to FIG. 2, device 10 is used to apply butter 50 to an ear of corn 52. Upon initial use, cavity 30 is entirely or substantially filled with butter 50. Should device 10 have been refrigerated prior to use, it may be desirable to warm the device to soften butter 50, thereby easing the dispensing and application processes. In that event, device 10 may be microwaved, wherein in a particularly preferred embodiment where the device has been exposed to typical household refrigerator conditions, device 10 may be microwaved for about 5 to about 15 seconds using a conventional household microwave on a regular heating power setting.

Once butter 50 has achieved its desired consistency, cap 22 is removed (unless cap 22 is not microwave safe, in which event cap 22 is first removed prior to placing device 10 in the microwave), and device 10 is positioned over ear of corn 52 by holding handle 11 and aligning bottom surface 18 of arcuate body 14 transversely across a length 54 of ear of corn 52. Once properly aligned, device 10 is lowered over ear of corn 52. As flanges 15 and 17 make contact with ear of corn 52, a resulting expansive force causes flanges 15 and 17 to expand outward thereby allowing ear of corn 52 to fit within a space 60.

When properly fitted into space 60, flanges 15 and 17 relax, and rest against an exterior surface of ear of corn 52 (See FIG. 2(*b*)). At that point, all or most of the surface area of bottom surface 18 is in direct physical contact with an exterior surface of ear of corn 52.

Referring to the embodiment depicted in FIG. 2, handle 11 is then squeezed to generate a compressive force 62 which expels butter 50 from handle 11 and moves it into cavity 13 of arcuate body 14 (see FIG. 4(*b*)).

Use of device 58, as shown in FIG. 4, is similar to that of the embodiment depicted in FIG. 2. Referring to FIG. 4, all steps in the use of device 58 is identical to that of the use of device 10 except that the compressive force used to expel butter 50 is applied to housing 63 rather than to handle 11. The compressive force exerted against housing 63 of container 60 causes butter 50 to flow from interior 64 out through the channel of protrusion 68 and into cavity 30 of handle 11. Continued application of the compressive force onto housing 63 moves butter 50 from cavity 30 into cavity 13 of body 14 and out onto ear of corn 52 by way of perforations 20.

In either of the embodiments depicted in FIGS. 2 and 4, the continued flow of butter 50 through cavity 30 of handle 11 pushes the movement of butter 50 through cavity 13 of arcuate body 14, thereby causing butter 50 to flow out of device 10 via plurality of perforations 20 such that butter 50 is disposed onto ear of corn 52. Ear of corn 52 is evenly coated with butter 50 by sliding device 10 or 58 along length 54 of ear of corn 52. Once length 54 of ear of corn 52 is coated, unbuttered or uncoated sections of ear of corn 52 may be coated by rotating device 10 in a direction transverse to length 54 of ear of corn 52 (see FIG. 4(*c*)), compressing handle 10 (FIG. 4) or housing 63 (FIG. 6), and again sliding respective device 10 and device 58 along the length of ear of corn 52.

Once butter 50 has been applied to a user's satisfaction, the user pushes up on handle 11 (FIG. 2) or on housing 63 (FIG. 4) causing flanges 15 and 17 to expand, and thereby disengaging respective device 10 or 58 from ear of corn 52. Once removed from ear of corn 52, device 10 or 58 returns to its original shape, i.e., its shape prior to disposing device 10 onto ear of corn 52. Cap 22 may then be placed back on arcuate body 14, and, device 10 or 58 may be refrigerated until future use.

Based on the above description of the inventive device and method of use, it should be apparent that the device of the present invention comprises several improvements over prior art applicators and/or dispensers. For example, the present inventive device accommodates a variety of dimensioned food items as the device comprises a pliable, elastic material. Furthermore, the device allows for the use and storage of a relatively large quantity of food spread, thereby eliminating the need of loading the device with a food spread every time the device is used. Additionally, the device comprises a relatively simple design with relatively few component parts, thereby simplifying the manufacturing process, and reducing the overall costs of manufacturing as compared to the manufacturing processes and costs associated with prior art dispensers and/or applicators. Also, the device may be used to dispense and evenly apply a wide variety of materials to complementary items, thereby enhancing the functionality of the inventive device.

With respect to the above description, it is to be realized that the optimum dimensional relationships for the parts of the invention, including variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A dispenser and applicator device for applying a spreadable material onto a cylindrical food item comprising:

an elongated handle formed from a micro-wave safe, compressible material and having a first end, an opposite second end and a removable cap closing an opening at said first end wherein said elongated handle defines a hollow interior cavity adapted to hold a spreadable material;

an arcuate body formed from a micro-wave safe elastic material and having a top convex surface, a bottom concave surface and a plurality of perforations in said bottom convex surface wherein said arcuate body defines a cavity therein which extends through a substantial portion thereof, said elastic material of said arcaute body enabling said arcuate body to be deformable to thereby adjust to food items having a variety of diameters;

said handle second end being connected to said top convex surface of said arcuate body with said handle first end extending from and unconnected with said top convex surface of said arcuate body such that said hollow interior cavity of said handle is in fluid communication with said cavity in said arcuate body;

first and second flanges extending outwardly from respective opposite ends of said arcuate body; and a removable cap fitted over said plurality of perforations;

whereby the bottom concave surface is adapted to be placed adjacent a cylindrical food item and said handle is adapted to receive spreadable material via said opening such that said handle may be squeezed to dispense the spreadable material from said interior cavity in said handle, into said cavity in said arcuate body, out of said perforations and onto the cylindrical food item.

* * * * *